US008597494B2

(12) United States Patent
Fan et al.

(10) Patent No.: US 8,597,494 B2
(45) **Date of Patent: *Dec. 3, 2013**

(54) METHOD FOR PRODUCING ULTRA-CLEAN GASOLINE

(75) Inventors: Yu Fan, Beijing (CN); Xiaojun Bao, Beijing (CN); Gang Shi, Beijing (CN); Haiyan Liu, Beijing (CN)

(73) Assignee: China University of Petroleum—Beijing (CUPB), Beijing (CN)

( * ) Notice: Subject to any disclaimer, the term of this patent is extended or adjusted under 35 U.S.C. 154(b) by 649 days.

This patent is subject to a terminal disclaimer.

(21) Appl. No.: 12/726,151

(22) Filed: Mar. 17, 2010

(65) Prior Publication Data

US 2010/0236979 A1 Sep. 23, 2010

(30) Foreign Application Priority Data

Mar. 19, 2009 (CN) ..... 2009 1 0080110

(51) Int. Cl.
*C10G 51/06* (2006.01)

(52) U.S. Cl.
USPC ..... 208/80; 208/60

(58) Field of Classification Search
USPC ..... 208/60; 585/258
See application file for complete search history.

(56) References Cited

U.S. PATENT DOCUMENTS

| | | | | |
|---|---|---|---|---|
| 4,062,762 | A * | 12/1977 | Howard et al. | 208/211 |
| 5,308,471 | A | 5/1994 | Apelian et al. | |
| 5,326,462 | A * | 7/1994 | Shih et al. | 208/89 |
| 5,360,532 | A * | 11/1994 | Fletcher et al. | 208/89 |
| 5,411,658 | A | 5/1995 | Chawla et al. | |
| 5,413,697 | A | 5/1995 | Fletcher et al. | |
| 5,770,046 | A * | 6/1998 | Sudhakar | 208/216 R |
| 5,770,047 | A | 6/1998 | Salazar et al. | |
| 2005/0092655 | A1 | 5/2005 | Nicolaos et al. | |
| 2005/0137434 | A1* | 6/2005 | Li et al. | 585/258 |
| 2005/0269245 | A1* | 12/2005 | Huve | 208/89 |
| 2008/0116112 | A1 | 5/2008 | Umansky et al. | |
| 2008/0302001 | A1* | 12/2008 | Koivusalmi et al. | 44/308 |

FOREIGN PATENT DOCUMENTS

| | | |
|---|---|---|
| CN | 1465666 | 1/2004 |
| CN | 1488722 | 4/2004 |
| CN | 1718688 | 1/2006 |
| CN | 1743425 | 3/2006 |

OTHER PUBLICATIONS

Jorge Ramírez, Patricia Rayo, Aí da Gutiérrez-Alejandre, Jorge Ancheyta, Mohan S. Rana, Analysis of the hydrotreatment of Maya heavy crude with NiMo catalysts supported on TiO2—Al2O3 binary oxides: Effect of the incorporation method of Ti, Catalysis Today, vol. 109, Issues 1-4, Nov. 30, 2005, pp. 54-60, http://www.sciencedirect.com/science.*

Tatiana Klimova, Dora Solís Casados, Jorge Ramírez, New selective Mo and NiMo HDS catalysts supported on Al203—MgO(x) mixed oxides, Catalysis Today, vol. 43, Issues 1-2, Aug. 13, 1998, pp. 135-146, (http://www.sciencedirect.com/science/article/pii/S0920586198001424).*

Yu Fan, Jun Lu, Gang Shi, Haiyan Liu, Xiaojun Bao, Effect of synergism between potassium and phosphorus on selective hydrodesulfurization performance of Co—Mo/Al203 FCC gasoline hydro-upgrading catalyst, Catalysis Today, vol. 125, Issues 3-4, Jul. 30, 2007, pp. 220-228, http://www.sciencedirect.com.*

Jorge Ramirez, Patricia Rayo, Aida Gutierrez-Alejandre, Jorge Ancheyta, Mohan S. Rana, Analysis of the hydrotreatment of Maya heavy crude with NiMo catalysts supported on TiO2—Al203 binary oxides: Effect of the incorporation method of Ti, Catalysis Today, vol. 109, Issues 1-4, Nov. 30, 2005, pp. 54-60, http://www.sciencedirect.com/science.*

Tatiana Klimova, Dora Solis Casados, Jorge Ramirez, New selective Mo and NiMo HDS catalysts supported on Al203—MgO(x) mixed oxides, Catalysis Today, vol. 43, Issues 1-2, Aug. 13, 1998, pp. 135-146, (http://www.sciencedirect.com/science/article/pi i/S09205861980014 2 4 ).*

Ping Liu, Jie Ren, Yuhan Sun, Influence of template on Si distribution of SAPO-11 and their performance for n-paraffin isomerization, Microporous and Mesoporous Materials, vol. 114, Issues 1-3, Sep. 1, 2008, pp. 365-372, ISSN 1387-1811, 10.1016/j.micromeso.2008.01.022. (http://www.sciencedirect.com/science/article/pii/S1387181108000255).*

* cited by examiner

*Primary Examiner* — Randy Boyer
*Assistant Examiner* — Juan Valencia
(74) *Attorney, Agent, or Firm* — Michael Fedrick; Loza & Loza, LLP

(57) ABSTRACT

The present invention relates to a method for producing ultra-clean gasoline. The invention provides a method of hydro-upgrading inferior gasoline through deep desulfurization and octane number recovery, which comprises the following steps: cutting inferior full-range gasoline into the light and heavy fraction gasolines; contacting the light fraction gasoline successively with a catalyst for selective diene removal and a catalyst for desulfurization and hydrocarbon aromatization/single-branched-chain hydroisomerization; contacting the heavy fraction gasoline with a catalyst for selective hydrodesulfurization, and contacting the reaction effluent with a catalyst for supplemental desulfurization and hydrocarbon multi-branched-chain hydroisomerization; and blending the treated light and heavy fraction gasolines to obtain the ultra-clean gasoline product. The method of the invention is suitable for hydro-upgrading inferior gasoline, especially for hydro-upgrading inferior FCC gasoline with ultra-high sulfur content and high olefin content to obtain excellent hydro-upgrading effects.

14 Claims, No Drawings

METHOD FOR PRODUCING ULTRA-CLEAN GASOLINE

TECHNICAL FIELD

The invention relates to a method for producing ultra-clean gasoline, especially to a hydro-upgrading method by deep desulfurization and octane number recovery for inferior gasoline, in particular for poor fluid catalytic cracking (FCC) gasoline with ultra-high sulfur compounds and high olefins in the field of petroleum refining.

RELATED ART

Currently, the high sulfur and olefin contents in FCC gasoline have become a main source of trouble in the production of clean gasoline worldwide. In the case of deficient reformed gasoline and alkylated gasoline with high octane number, the hydro-upgrading of FCC gasoline becomes one of the key technologies for the production of clean fuels for vehicles in order to meet increasingly strict standards required for clean gasoline.

U.S. Pat. No. 5,770,047, U.S. Pat. No. 5,413,697, U.S. Pat. No. 5,411,658, and U.S. Pat. No. 5,308,471 have disclosed a desulfurization and olefin-reducing process primarily based on hydrofining and cracking/single-branched-chain hydroisomerization. This process includes cutting full-range FCC gasoline into the light and heavy fractions, deeply desulfurizing the heavy fraction of FCC gasoline by using conventional hydrofining catalysts to convert olefin into alkane completely, then carrying out alkane cracking and hydroisomerization reaction over the highly acidic HZSM-5 zeolite-based catalyst, and finally obtaining the full-range upgraded gasoline by blending the light and heavy fractions. According to the description of the above patents, the liquid yield of the final blended product is 94 wt % by weight, and the loss of research octane number (RON) in gasoline is about 2.0 units.

US2008116112A1 has disclosed a method for upgrading gasoline with high aromatic and sulfur contents. The procedures of such upgrading method disclosed by this patent are as follows: firstly the gasoline is cut into the light and heavy fractions, then the light fraction undergoes a alkylation reaction in a fixed-bed reactor followed by a desulfurization process without hydrogen, and the heavy fraction is subjected to an alkylation reaction between olefins and sulfur compounds to make the boiling point of the sulfur compounds therein higher than the end boiling point of the heavy gasoline and the sulfur compounds with the higher boiling point removed by cutting. This method cannot remove the sulfur compounds in gasoline, but only excludes the obtained sulfur compounds with the higher boiling point from gasoline by cutting and fractionating.

US2005092655A1 has disclosed a desulfurization method for gasoline including the following steps: firstly cutting gasoline into the light and heavy fractions to allow the light thiophene and methylthiophene to remain in the light fraction and the heavy aromatic sulfur compounds to remain in the heavy fraction, then subjecting the heavy fraction to hydrodesulfurization and desulfurizing the light fraction in contact with solid adsorbents. Since the feedstock used in this method is a model gasoline composed of a mixture of monomer sulfur compounds and monomer hydrocarbons, it is difficult to predict the upgrading effect of the method on real FCC gasoline.

Although desulfurization and olefin reduction could be achieved by the above-mentioned gasoline hydro-upgrading methods, the targeted feedstock generally has an olefin content of 20-30 v % by volume and a high aromatics content (about 25 v % by volume). For the gasoline with high olefin and sulfur contents but low aromatics content (about 15 v % by volume), such as Chinese FCC gasoline in which the olefin content is up to 40 v % by volume or more, the above hydro-upgrading process can lead to the great saturation of olefins via hydrogenation, substantially increasing the loss in gasoline octane number. Therefore, these upgrading technologies reported publicly are clearly not applicable to the above case. In view of this, aiming at the particularity of Asian (especially Chinese) FCC gasoline, a more scientifically rational method for upgrading more inferior gasoline has always been a research focus in the petroleum refining industry.

CN1465666A (Chinese Patent Application No. 02121595.2) and CN1488722A (Chinese Patent Application No. 02133111.1) have provided a method for deep desulfurization and olefin reduction of gasoline. According to the above-mentioned characteristics of Chinese FCC gasoline, the method involves subjecting the heavy gasoline fraction to hydrodesulfurization, hydrodenitrogenation and complete olefin saturation over a hydrofining catalyst, then cracking and hydroisomerizing of the formed alkanes with low octane number to recover the product octane number over a catalyst with sufficiently acidic function, and finally mixing the light and heavy fractions to obtain the final upgraded product. According to the description of the above patent, olefins are completely saturated by hydrogenation in the first reaction stage, so it is required to increase the cracking ability of the second-stage catalyst to recover the product octane number, which results in a significant reduction in the product liquid yield (only 86%) and greatly increases the processing cost.

CN1743425A (Chinese Patent Application No. 200410074058.7) has disclosed a hydro-upgrading process for Chinese FCC gasoline with high olefin content. Wherein, after the full-range FCC gasoline undergoes the three reactions of diene removal, olefin aromatization and supplemental olefin reduction, the full-range product is obtained with a desulfurization ratio at 78%, the content of olefins at 30 v % by volume, the RON loss at 1.0 unit, and the liquid yield at about 98.5 wt % by weight. However, this method is only suitable for FCC gasoline with low sulfur content, and has a low desulfurization ratio and a poor olefin reduction, leading to worse product quality than that regulated by European III and IV standard for clean gasoline. Thereby, this method is obviously not suitable for the FCC gasoline feedstock with the medium and high sulfur content.

CN1718688A (Chinese Patent Application No. 200410020932.9) has disclosed a hydro-upgrading method for inferior FCC gasoline. This method includes removing dienes in full-range FCC gasoline at high feeding space velocity (6 $h^{-1}$) over a conventional hydrofining catalyst, followed by olefin aromatization at high temperature (415° C.) using a nano-zeolite catalyst and by selective desulfurization at high temperature (415° C.) and higher space velocity (40 $h^{-1}$) using a Co—Mo—K—P/$Al_2O_3$ catalyst. The resulting product has low olefin and sulfur contents, while the RON loss of the product is about 3.0 units and the product liquid yield is only about 94 wt % by weight. The nano-zeolite with complicated preparation is prone to be deactivated at high temperature and has a poor regeneration performance. In addition, the desulfurization catalyst in the third stage also tends to be deactivated at very high space velocity and very high temperature. Thus, the reaction stability of the whole process is undesirable.

In summary, for inferior fuels such as FCC gasoline with high sulfur and olefin contents, it has been attempted in different ways to achieve desulfurization and olefin reduction while maintaining and improving the product octane number as much as possible, and the effect of single-branched-chain hydroisomerization of hydrogenated product on the octane number recovery is also mentioned. However, the disclosed methods have their own advantages and disadvantages, especially lacking of a further concern about the importance of eco-friendly multi-branched-chain hydroisomerization of hydrocarbons in increasing the octane number of FCC gasoline. Thus, it is always the object sought in the petroleum refining field to probe for a more reasonable upgrading process and select the catalysts with suitable functions and activities, in order to achieve deep desulfurization and olefin reduction while maintaining octane number, and to solve problems such as undesirable catalyst stability and high processing cost.

SUMMARY

To solve the above technical problems, an object of the invention is to provide a method for producing ultra-clean gasoline, which belongs to a combined hydro-grading process for inferior gasoline. This method includes fractionating inferior full-range gasoline into the light and heavy fractions, then treating the light fraction and the heavy fraction respectively, and finally obtaining the ultra-clean gasoline product with the ultra-low sulfur content, the ultra-low olefin content and the high octane number by blending the respectively upgraded light and heavy fractions. This method is particularly suitable for upgrading inferior FCC gasoline with high olefin content and ultra-high sulfur content, and can achieve the effects of ultra-deep desulfurization, great olefin reduction and octane number recovery.

To accomplish the above objects, the invention provides a method of hydro-upgrading inferior gasoline through ultra-deep desulfurization and octane number recovery, comprising:

cutting inferior full-range gasoline into the light and heavy fraction gasolines;

contacting the light fraction gasoline with the catalyst for selective diene removal and the catalyst for desulfurization and hydrocarbon aromatization/single-branched-chain hydroisomerization;

contacting the heavy fraction gasoline with the catalyst for selective hydrodesulfurization in a first reactor, and contacting the reaction effluent from the first reactor with the catalyst for supplemental desulfurization and hydrocarbon multi-branched-chain hydroisomerization in a second reactor; and blending the treated light and heavy fraction gasolines to obtain the ultra-clean gasoline product.

The inferior gasoline generally has an olefin content of between 40% and 60% by volume and a sulfer content of greater than 1000 $\mu g \cdot g^{-1}$. The inferior full-range gasoline has a distillation temperature range between about 30° C. and about 220° C.

In the hydro-upgrading method of inferior gasoline provided by the invention, firstly, the full-range inferior gasoline was pre-fractionated (cut), and then the obtained light and heavy fractions of the gasoline were treated by different combined processes including olefin reduction, deep desulfurization and octane number recovery. For the light fraction gasoline, dienes are removed using a catalyst for selectively removing unstable dienes in the gasoline, and the following effluent contacts with a catalyst for desulfurization and hydrocarbon aromatization/single-branched-chain hydroisomerization to remove thiophene sulfurs, lower olefin content and recover octane number. For the heavy fraction gasoline, the difficulty-removed sulfur compounds (alkyl thiophene and benzothiophene) and the unstable dienes are firstly removed therefrom using a catalyst with selective hydrodesulfurization function in the first reactor, so as to avoid polymerization of dienes in the following treatment that affects the service life of the catalyst in the second reactor, and to solve the problem that the sterically hindered sulfur compounds can hardly be removed by the subsequent catalyst at the same time. Upon entry into the second reactor, the reaction effluent from the first reactor with no diene yet many of olefins and the suitable content of thiophene sulfurs, contacts with the catalyst for supplemental desulfurization and hydrocarbon multi-branched-chain hydroisomerization. After blending the treated light and heavy fractions, ultra-clean gasoline products with ultra-low sulfur content, ultra-low olefin content and high octane number can be obtained, so the object of ultra-deep desulfurization, great olefin reduction and good octane recovery for inferior gasoline can be achieved.

The hydro-upgrading method provided by the invention is suitable for inferior gasoline including one of FCC gasoline, coker gasoline, catalytic pyrolysis gasoline, thermal cracking gasoline, and steam pyrolysis gasoline or a mixture of the above several kinds.

In the hydro-upgrading method provided by the invention, preferably, for the light and heavy fraction gasolines, the cutting temperature is between 80 and 110° C. The light fraction gasoline has a boiling point which is less than the cutting temperature, and the heavy fraction gasoline has a boiling point which is more than the cutting temperature.

According to the specific technical solution of the invention, preferably, the catalyst system used in the hydro-upgrading of the light fraction gasoline includes the catalyst for selective diene removal and the catalyst for desulfurization and hydrocarbon aromatization/single-branched-chain hydroisomerization which are loaded in the same reactor successively along the flow direction of the reactant. In other words, the light fraction gasoline successively contacts with the above two catalysts.

In the hydro-upgrading method provided by the invention, the light fraction gasoline is subjected to the removal of unstable dienes by using the catalyst for selective diene removal. Preferably, based on the total weight of the catalyst, the above catalyst for selective diene removal comprises 4-7 wt % $MoO_3$, 1-3 wt % NiO, 3-5 wt % $K_2O$, and 1-4 wt % $La_2O_3$, with the balance of $Al_2O_3$.

In the hydro-upgrading method provided by the invention, after the diene removal, the light fraction gasoline is subjected to desulfurization of thiophene sulfurs, olefin reduction, and octane number recovery by using the catalyst for desulfurization and hydrocarbon aromatization/single-branched-chain hydroisomerization. Preferably, based on the total weight of the catalyst, the above catalyst for desulfurization and hydrocarbon aromatization/single-branched-chain hydroisomerization comprises 2-6 wt % NiO, 4-10 wt % $MoO_3$, 1-5 wt % CoO, 2-5 wt % $B_2O_3$, about 50-70 wt % of the alkali treated-ammonium exchanged-hydrothermally treated HZSM-5 zeolite, with the balance of Al—Ti composite oxides.

In the hydro-upgrading method provided by the invention, in the first reactor, by contacting the heavy fraction gasoline with the catalyst for selective hydrodesulfurization, the sulfur compounds which are relatively difficult to be removed (alkyl thiophene and benzothiophene) and the unstable dienes therein may be removed, avoiding the polymerization of dienes in the following treatment that deteriorates the service life of the catalyst in the second reactor. Preferably, based on the total weight of the catalyst, the above catalyst for selective hydrodesulfurization comprises 10-18 wt % $MoO_3$, 2-6 wt % CoO, 1-7 wt % $K_2O$ and 2-6 wt % $P_2O_5$, with the balance of Al—Ti—Mg composite oxides.

In the hydro-upgrading method provided by the invention, preferably, based on the total weight of the catalyst, the catalyst for supplemental desulfurization and hydrocarbon multi-branched-chain hydroisomerization used in the second reactor to treat the heavy fraction gasoline comprises 3-8 wt % $MoO_3$, 1-3 wt % CoO, 2-5 wt % NiO, about 50-70 wt % SAPO-11 zeolites, with the balance of Al—Ti composite oxides.

According to the specific technical solution of the invention, preferably, the SAPO-11 zeolite used in the invention has a molar ratio of $SiO_2/Al_2O_3$ as 0.1-2.0:1, and a molar ratio of $P_2O_5/Al_2O_3$ as 0.5-2.5:1.

According to the specific technical solution of the invention, preferably, the SAPO-11 zeolite used in the invention may use $C_2$-$C_8$ alkyl silicon esters as organic silicon sources, and can be synthesized by adding the organic silicon source together with an organic alcohol that is the same as the alcohol from the hydrolysis of the organic silicon source, i.e., a corresponding alcohol with a carbon chain of $C_2$-$C_8$. Compared with the conventional SAPO-11 zeolites, the addition of the organic alcohol employed in the invention can regulate the hydrolysis degree of the silicon source and thus suppress the hydrolysis of the organic silicon, expanding the pore size of conventional SAPO-11 zeolites and thereby improving their multi-branched-chain hydroisomerization performance. Specifically, the organic silicon source can be selected from the long-chain organic silicons such as tetraethyl orthosilicate, tetrapropyl orthosilicate, tetrabutyl orthosilicate, tetrapentyl orthosilicate or tetrahexyl orthosilicate, and the organic alcohol can be correspondingly selected from ethanol, propanol, n-butanol, n-pentanol or n-hexanol. For example, when the organic silicon source is tetraethyl orthosilicate, the corresponding ethanol is chosen as the organic alcohol. To adjust the pore size of the SAPO-11 zeolite, the template used in the SAPO-11 synthesis is preferably a mixture of di-n-propylamine and long-chain organic amine with a molar ratio of 3-10:1, and the long-chain organic amine is selected from those alkyldiamines having a carbon chain length of $C_4$-$C_8$. The long-chain organic amine can be, for example, one of di-n-butylamine, di-n-pentylamine, and di-n-hexylamine, in order to facilitate the regulation of the pore structure of the zeolite, especially to increase the pore size of the zeolite to meet the reaction requirement for hydrocarbon multi-branched-chain hydroisomerization.

The other raw materials used in the synthesis of the SAPO-11 zeolite and the proportion thereof may be determined according to the conventional operations. For example, the feeding ratio of the raw materials can be determined as organic silicon source:aluminum source:phosphorus source: template:organic alcohol:water=0.1-2.0:1:0.5-2.5:0.7-2.0: 0.1-40:20-60 (in molar ratio). The specific synthesis process can be as follows:

the phosphorus source and the aluminum source are evenly mixed in water according to the predetermined proportion to form a sol, with the mixing temperature generally at 20-40° C. or room temperature;

the mixture solution of the organic silicon source and the organic alcohol is added into the above sol, mixed evenly by stirring, and the template is then added to prepare an initial gel mixture;

the obtained initial gel mixture is crystallized by heating at the crystallization temperature of 150-200° C. for 8-60 hours. Upon the completion of crystallization, the solid product is separated from the mother solution, washed till neutral and dried (for example, dried in air at 110-120° C.) to form the raw powder of the SAPO-11 zeolite that is calcined at 500-600° C. for 4-6 hours.

According to the specific technical solution of the invention, preferably, the HZSM-5 zeolite used in the invention is the alkali treated-ammonium exchanged-hydrothermally treated HZSM-5 zeolite, which can be prepared by the method including the following steps: the HZSM-5 zeolite (the molar ratio of silica/alumina is 30-60) is added into the alkaline solution of NaOH according to a liquid-solid ratio of 5-15 mL/g, and after adjusting the solution pH value to 9-14 the mixture is stirred at 60-90° C. for 2-6 hours, filtered, washed and dried at 110-130° C. for 2-6 hours; then the obtained product is added into the ammonium nitrate solution wherein the weight ratio of zeolite:ammonium salt:water is 1:0.2-1.8:5-15, stirred at 60-98° C. for 2-6 hours, filtered and washed, dried at 110-130° C. for 2-4 hours and calcined at 450-520° C. for 2-6 hours to obtain the alkali treated-ammonium exchanged HZSM-5 zeolite; finally the above alkali treated-ammonium exchanged HZSM-5 zeolite is subjected to the steaming treatment at 550-750° C. for 20-50 mins to obtain the modified HZSM-5 zeolite (the alkali treated-ammonium exchanged-hydrothermally treated HZSM-5 zeolite).

According to the specific technical solution of the invention, preferably, the weight composition of the Al—Ti composite oxide used in the catalysts of the invention (namely, based on the weight of the catalyst for desulfurization and hydrocarbon aromatization/single-branched-chain hydroisomerization or the catalyst for supplemental desulfurization and hydrocarbon multi-branched-chain hydroisomerization) is 15-40 wt % $Al_2O_3$ and 2-15 wt % $TiO_2$, and the Al—Ti composite oxide binder is prepared by the fractional precipitation of aluminum and titanium salts.

According to the specific technical solution of the invention, preferably, the weight composition of the Al—Ti—Mg composite oxides used in the catalyst of the invention (namely, based on the weight of the catalyst for selective hydrodesulfurization) is 60-75 wt % $Al_2O_3$, 5-15 wt % $TiO_2$ and 3-10 wt % MgO, and the Al—Ti—Mg composite oxides are prepared by the fractional precipitation of aluminum, titanium and magnesium salts.

In the hydro-upgrading method provided by the invention, preferably, when treating the light fraction gasoline, the catalyst for selective diene removal uses alumina as the carrier, and the catalyst for desulfurization and hydrocarbon aromatization/single-branched-chain hydroisomerization uses a carrier composed of the alkali treated-ammonium exchanged-hydrothermally treated HZSM-5 zeolite and the Al—Ti composite oxide; when treating the heavy fraction gasoline, the catalyst for selective hydrodesulfurization employed in the first reactor uses the Al—Ti—Mg composite oxide as the carrier, and the catalyst for supplemental desulfurization and hydrocarbon multi-branched-chain hydroisomerization used in the second reactor uses a carrier composed of the Al—Ti composite oxide and the SAPO-11 zeolite.

According to the specific technical solution of the invention, a pH swing method is used for preparing the alumina precipitates and the Al—Ti—Mg composite oxide carrier, which includes: adding a alkali precipitator (the amount of the alkali precipitator used for the first time at about 15-30 v % by volume of the total amount of the aluminum salt solution), such as commonly used sodium hydroxide solution or a mixed ammonia solution (for example, a mixed solution of $NH_3.H_2O$ and $NH_4HCO_3$ with a molar ratio of 2-10:1), with the aluminum salt solution under constant and violent stirring, continuing to add the aluminum salt solution after depleting the suitable amount of the alkali precipitator until the pH value is appropriately acidic (for example, pH=2-4), further adding the alkali precipitator solution after stirring for a while (5-30 mins) until the pH value is appropriately alkaline (for example, pH=7.5-9.5), stirring for an additional period of time (5-30 mins) and repeating such pH swing for a couple of times (usually 2-5 times) to obtain alumina precipitates; stirring for a period of time under the suitable alkaline pH value after depleting the aluminum salt solution, then adding a mixed solution of magnesium salt and titanium salt while maintaining an alkaline solution to promote the occurrence of co-precipitation reaction; continuing to stir for a period of time (5-30 mins) after the completion of feeding and precipitation, followed by cooling, filtering, beating and washing for a couple of times, subsequently drying, and crushing and sieving the filter cake to obtain the Al—Ti—Mg composite carrier powders. In the preparation of the composite oxides, the salt solutions of aluminum, titanium and magnesium can be the solutions of their nitrate, chloride, and sulfate. The specific process for preparing alumina by the above pH swing method can be performed according to the methods publicly reported or applied. The carrier powders obtained by the fractional precipitation can be shaped in an extruder using a conventional shaping method, and then dried and calcined to obtain the carrier of the corresponding catalyst.

According to the specific technical solution of the invention, the preparation method of Al—Ti composite oxide powders is almost the same as that of the Al—Ti—Mg composite oxide mentioned above, except for the only incorporation of titanium salt solution in the second step of precipitation.

According to the specific technical solution of the invention, preferably, different from the conventional mechanical mixing, the SAPO-11 zeolite employed in the invention grows in-situ on the Al—Ti composite oxide. The method can be implemented as follows: preparing a mixture sol by evenly mixing a phosphorus source (such as phosphoric acid) and an aluminum source (such as pseudoboehmite) with deionized water by stirring at 20-40° C. or room temperature for 1.0-2.0 hours, then adding the mixed solution of organic silicon source and organic alcohol in the obtained sol and stirring the mixture for 2.0-3.0 hours, subsequently adding a sufficiently blended mixture of the Ai-Ti composite oxide and a template, and continuing to stir until a uniform colloidal is formed; the colloidal is then loaded into a stainless-steel autoclave lined with polytetrafluoroethylene to crystallize at 150-200° C. for 8-60 hours, and after crystallization the solid product is separated from the mother solution, washed till neutral and then dried at 110-120° C. to obtain the catalyst carrier.

In accordance with the means of expression frequently used in the catalyst field, the contents of the carrier and active components (elements) on the catalysts mentioned by the invention are determined in terms of the corresponding oxides thereof.

According to the specific technical solution of the invention, when hydro-upgrading inferior gasoline using the hydro-upgrading method of the invention, preferably, the reaction conditions for the light fraction gasoline obtained by cutting can be controlled with a reaction pressure of 1-3 MPa, a reaction temperature of 370-430° C., a hydrogen/oil volume ratio of 200-600, a liquid volume space velocity of 12-16 $h^{-1}$ for the catalyst with the function of selective diene removal, and a liquid volume space velocity of 1-4 $h^{-1}$ for the catalyst with the functions of desulfurization and hydrocarbon aromatization/single-branched-chain hydroisomerization.

According to the specific technical solution of the invention, when hydro-upgrading inferior gasoline using the hydro-upgrading method of the invention, preferably, the reaction conditions for the heavy fraction gasoline obtained by cutting in the first reactor can be controlled with a reaction pressure of 1-3 MPa, a liquid volume space velocity of 3-6 $h^{-1}$, a reaction temperature of 230-290° C., and a hydrogen/oil volume ratio of 200-600; and, the reaction conditions of the reaction effluent from the first reactor in the second reactor are a reaction pressure of 1-3 MPa, a liquid volume space velocity of 1-4 $h^{-1}$, a reaction temperature of 300-360° C., and a hydrogen/oil volume ratio of 200-600.

The method of the invention is suitable for hydro-upgrading inferior gasoline, especially for hydro-upgrading inferior FCC gasoline with ultra-high sulfur content and high olefin content, e.g., FCC gasoline with the sulfur content of 1400-2500 $\mu g \cdot g^{-1}$ and the olefin content of 40-55 v % by volume.

Compared with the existing technologies, the method of hydro-upgrading inferior gasoline through ultra-deep desulfurization and octane number recovery provided by the invention is characterized in that:

(1) FCC gasoline with the sulfur content of 1400-2500 $\mu g \cdot g^{-1}$ and the olefin content of 40-55 v % by volume can be hydro-upgraded to the high-quality gasoline with the sulfur content of equal to or less than 30 $\mu g \cdot g^{-1}$, the olefin content of equal to or less than 15 v % by volume, the RON loss in equal to or less than 1.0 unit, and the product liquid yield of more than or equal to 98 wt % by weight;

(2) the light fraction gasoline can be processed in such a manner that the two types of catalysts are loaded in the same reactor, while the heavy fraction gasoline can be processed in series without the separating equipment during the treatment;

(3) heat is sufficiently utilized, operating is easy, and the desired temperature can be achieved for heavy fraction gasoline in the first reactor through the heat exchange with the high-temperature product of light fraction gasoline at the exit of the upgrading reactor for the light fraction gasoline, avoiding additional heating equipment;

(4) for the inferior gasoline to be treated, the inferior full-range gasoline is firstly prefractionated into the light and heavy fraction gasolines; then the light fraction gasoline is treated through diene removal, and desulfurization and hydrocarbon aromatization/single-branched-chain hydroisomerization, and the heavy fraction gasoline is subjected to a two-stage treatment of selective hydrodesulfurization, and supplemental desulfurization and hydrocarbon multi-branched-chain hydroisomerization; these multiple reactions contribute to achieve the effects including the ultra-deep desulfurization, the great olefin reduction, and the octane number recovery of the blended full-range gasoline product; and (5) The hydro-upgrading method of the invention is especially suitable for upgrading more inferior gasoline with the ultra-high sulfur content and the high olefin content, increasing the octane number thereof and maintaining a high liquid yield of the product while significantly reducing the olefin and sulfur contents thereof; therefore, compared with the foreign methods of gasoline hydro-upgrading, the hydro-upgrading method of the invention is more advantage for treating inferior gasoline.

BEST MODES OF CARRYING OUT THE INVENTION

Now, the embodiments and features of the technical solution of the invention will be described in detail combined with specific examples in order to help the reader to understand the spirit and beneficial effect of the invention, which should not be construed as any limitation to the range within which the invention can be implemented.

Example 1

In this example, a hydro-upgrading treatment was carried out on inferior FCC gasoline with ultra-high sulfur content and high olefin content (feedstock 1), wherein the sulfur content is 1750 $\mu g \cdot g^{-1}$ and the olefin content is 48.4 v % by volume.

(1) Cutting the Full-Range Gasoline Feedstock

The above inferior full-range FCC gasoline was cut into the light and heavy fraction gasolines at 85° C., and the properties of the full-range gasoline and the cut light and heavy fractions are shown in Table 1.

TABLE 1

Properties of Feedstock 1

| Item | Full-range gasoline | Light fraction <85° C. | Heavy fraction >85° C. |
|---|---|---|---|
| Yield (wt %) | 100 | 42.4 | 57.6 |
| Density (g/mL) | 0.735 | 0.665 | 0.780 |
| Distillation range (° C.) | 33-204 | 31-87 | 82-206 |
| Content of typical hydrocarbons (v %) | | | |
| Multi-branched-chain isoalkane | 2.2 | 1.3 | 2.9 |
| Olefin | 48.4 | 59.6 | 39.8 |
| Aromatics | 16.3 | 2.0 | 26.9 |
| Sulfur ($\mu g \cdot g^{-1}$) | 1750 | 290 | 2825 |
| Diene (gI/100 g) | 2.4 | — | — |
| RON | 91.3 | 94.6 | 89.5 |

(2) Upgrading the Light Fraction Gasoline Through Selective Diene Removal and Desulfurization and Hydrocarbon Aromatization/Single-Branched-Chain Hydroisomerization In a 200 mL hydrogenation reactor, the catalyst for selective diene removal was loaded on the upper layer, and the catalyst for desulfurization and hydrocarbon aromatization/single-branched-chain hydroisomerization was loaded on the lower layer. After the reactor airtightness was confirmed, these catalysts were pre-sulfurized by the conventional sulfurization process and the product was collected for analysis after reaction for 500 hours.

For the above catalyst for selective diene removal, based on stoichiometric ratio, the appropriate amounts of $K_2O$, $MoO_3$ along with NiO and $La_2O_3$ were loaded on the shaped alumina carrier successively by the conventional isovolumetric impregnation method, and the steps of aging, drying and calcining etc. were needed after each loading of active metal components; the composition by weight of this catalyst was 2 wt % NiO-4 wt % $MoO_3$-3 wt % $K_2O$-2 wt % $La_2O_3$/89 wt % $Al_2O_3$.

The composition by weight of the above catalyst for desulfurization and hydrocarbon aromatization/single-branched-chain hydroisomerization was 2 wt % NiO-6 wt % $MoO_3$-2 wt % CoO-3 wt % $B_2O_3$/61 wt % HZSM-5-21 wt % $Al_2O_3$-5 wt % $TiO_2$, in which the HZSM-5 was the alkali treated-ammonium exchanged-hydrothermally treated HZSM-5 zeolite prepared as follows: the HZSM-5 zeolite (the molar ratio of silica/alumina as 35) was added into the aqueous solution of NaOH based on a liquid-solid ratio of 10 mL/g, and after adjusting the pH value to 13 the resultant was stirred at 75° C. for 4 hours, filtered, washed till neutral and dried at 120° C. for 3 hours; the NaOH-treated HZSM-5 zeolite was mixed with ammonium nitrate and water based on the weight ratio of zeolite:ammonium nitrate:water as 1:0.8:10, and after stirring at 80° C. for 4 hours the product was filtered, washed, dried at 120° C., and then calcined at 480° C. for 4 hours to obtain the alkali treated-ammonium exchanged HZSM-5 zeolite; after crushed into particles of 20-40 meshes the obtained zeolite was treated in 100% steam at 610° C. for 35 mins in the hydrothermal treatment furnace to obtain the alkali treated-ammonium exchanged-hydrothermally treated HZSM-5 zeolite.

312.2 g $Al(NO_3)_3.9H_2O$ were added into 405.0 mL deionized water and stirred until complete dissolution to obtain an $A_1$ solution; 25.0 g $Ti(SO_4)_2$, were added into 285.0 mL deionized water and stirred violently until complete dissolution to obtain a $T_1$ solution; 90.0 mL precipitator (a mixed ammonia solution with the molar ratio of $NH_3.H_2O$ to $NH_4HCO_3$ as 8:1) and the $A_1$ solution were added concurrently into the container under strong stirring while the pH value was controlled at about 9.0, and the $A_1$ solution continued to be added after completing the addition of the mixed ammonia solution until the pH value was 4.0; after stirring for 10 mins, the mixed ammonia solution was added again until the pH value was 9.0, and the mixture was stirred again for 10 mins; after repeating such pH-swing twice, the $T_1$ solution was added while the pH value was controlled at about 9.0 with the mixed ammonia solution so as to allow titanium to precipitate completely; the resultant was stirred for 15 mins, filtered, beaten and washed twice with the $NH_4HCO_3$ solution of 0.8 mol/L, washed twice with deionized water, dried at 120° C. for 15 hours, and crushed and sieved to obtain 50 g of Ai-Ti composite oxide powders with 300 meshes.

Shaped from the above alkali treated-ammonium exchanged-hydrothermally treated HZSM-5 zeolite and Al—Ti composite oxide in a certain stoichiometric ratio using the conventional extrusion molding method, the obtained catalyst carrier was loaded with the appropriate amounts of $MoO_3$, NiO, CoO and $B_2O_3$ (the latter three being co-impregnated) successively based on the determined stoichiometric ratio, and the steps of aging, drying and calcining etc. were needed after each loading of active metal components.

The reaction conditions for the light fraction gasoline were a reaction pressure of 2.4 MPa, a reaction temperature of 380° C., a hydrogen/oil volume ratio of 500, a liquid volume space velocity of 14 $h^{-1}$ for the catalyst with the function of selective diene removal, and a liquid volume space velocity of 2.0 $h^{-1}$ for the catalyst with the functions of desulfurization and hydrocarbon aromatization/single-branched-chain hydroisomerization. The hydro-upgrading effects of the light fraction gasoline were shown in Table 2.

TABLE 2

Hydro-upgrading Effects of the Light Fraction Gasoline

| Item | Light fraction gasoline 1 <85° C. (feedstock) | Upgraded product of light fraction gasoline 1 |
|---|---|---|
| Yield (wt %) | — | 96.3 |
| Density (g/mL) | 0.665 | 0.713 |
| Distillation range (° C.) | 31-87 | 33-100 |
| Content of typical hydrocarbons (v %) | | |
| Multi-branched-chain isoalkane | 1.3 | 2.1 |
| Olefin | 59.6 | 18.4 |

TABLE 2-continued

Hydro-upgrading Effects of the Light Fraction Gasoline

| Item | Light fraction gasoline 1 <85° C. (feedstock) | Upgraded product of light fraction gasoline 1 |
|---|---|---|
| Aromatics | 2.0 | 14.5 |
| Sulfur ($\mu g \cdot g^{-1}$) | 290 | 17 |
| RON | 94.6 | 94.2 |

(3) Upgrading the Heavy Fraction Gasoline Through Selective Hydrodesulfurization and Supplemental Desulfurization and Hydrocarbon Multi-Branched-Chain Hydroisomerization In two 200 mL hydrogenation reactors in series, the catalyst for selective hydrodesulfurization was loaded in the first reactor, and the catalyst for supplemental desulfurization and hydrocarbon multi-branched-chain hydroisomerization was loaded in the second reactor. After the reactor airtightness was confirmed, these catalysts were pre-sulfurized by the conventional sulfurization process and the product was collected for analysis after reaction for 500 hours.

The composition by weight of the above catalyst for selective hydrodesulfurization loaded in the first reactor was 4 wt % CoO-12 wt % $MoO_3$-3 wt % $K_2O$-2 wt % $P_2O_5$/67 wt % $Al_2O_3$-8 wt % $TiO_2$-4 wt % MgO. The catalyst was prepared as follows: 631.8 g $Al(NO_3)_3.9H_2O$ and 819.7 mL deionized water were added therein, and stirred until complete dissolution to obtain an $A_2$ solution; 31.3 g $Ti(SO_4)_2$ and 357.7 mL deionized water were added therein, and strongly stirred until complete dissolution to obtain a $T_2$ solution; 32.1 g $Mg(NO_3)_2.6H_2O$ and 55.2 mL deionized water were added therein, and a $M_2$ solution was obtained upon dissolution. The $T_2$ and $M_2$ solutions were mixed and stirred evenly to obtain a $TM_2$ solution; 180.0 mL precipitator (a mixed ammonia solution with the molar ratio of $NH_3.H_2O$ to $NH_4HCO_3$ as 8:1) and the $A_2$ solution were added concurrently into the container under strong stirring while the pH value was controlled at about 9.0, and the $A_2$ solution continued to be added after completing the addition of the mixed ammonia solution until the pH value was 4.0; after stirring for 10 mins, the mixed ammonia solution was added again until the pH value was 9.0, and the mixture was stirred again for 10 mins; after repeating such pH-swing three times, the $TM_2$ solution was added when the pH was controlled at about 9.0 with the mixed ammonia solution so as to allow titanium and magnesium to precipitate completely; the resultant was stirred for 15 mins, filtered, beaten and washed twice with the $NH_4HCO_3$ solution of 0.6 mol/L, washed twice with deionized water, dried at 120° C. for 24 hours, and crushed and sieved to obtain 100 g of Ai-Ti—Mg composite oxide powders with 300 meshes.

70 g of the above Ai-Ti—Mg composite oxides powders (with a bound water content of 25 wt % by weight) and 1.6 g sesbania powders were mixed evenly by grinding, and then 5 mL nitric acid solution with the concentration of 65% by weight was added therein; after kneading sufficiently, the resultant was shaped in an extruder, dried at 120° C., and calcined at 520° C. to prepare the catalyst carrier of Al—Ti—Mg composite oxides.

40 g of the above shaped catalyst carrier of Al—Ti—Mg composite oxides were impregnated in the 35 mL mixed impregnating solution composed of potassium nitrate and diammonium phosphate which included 1.5 g of $K_2O$ and 1.0 g of $P_2O_5$ in terms of oxides, and then the resultant was aged at room temperature for 5 hours, dried at 120° C. for 3 hours and calcined at 520° C. for 4 hours; a 32 mL mixture solution of cobalt nitrate and ammonium molybdate including 2.0 g CoO and 6.1 g $MoO_3$ (the content of each active component was based on the oxide form, which does not limit the active components in the mixture solution to present in oxide form only) was prepared, and 3.3 mL ammonia with the concentration of 17% by weight were added therein, stirring sufficiently until the solid was dissolved completely so as to obtain the impregnating solution; then the above catalyst carrier containing potassium and phosphorus was impregnated in the solution containing cobalt and molybdate, aged at room temperature for 5 hours, dried at 120° C. for 3 hours and calcined at 520° C. for 5 hours to obtain the final catalyst.

The composition by weigh of the in-situ crystallized SAPO-11-Al—Ti catalyst for supplemental desulfurization and hydrocarbon multi-branched-chain hydroisomerization loaded in the above-mentioned second reactor was: 1 wt % CoO-6 wt % $MoO_3$-3 wt % NiO/64 wt % SAPO-11-22 wt % $Al_2O_3$-4 wt % $TiO_2$. The detailed preparation of such catalyst included the following steps: firstly, according to the feeding composition (molar ratio) for the SAPO-11 zeolite as PE (n-propanol):DPEA (di-n-pentylamine):DPA (di-n-propylamine):$Al_2O_3$:$P_2O_5$:$SiO_2$:$H_2O$=5:0.2:1:1:1:0.4:50, phosphoric acid, pseudo-boehmite and deionized water were evenly mixed by stirring for 1.0 hour, and an appropriate amount of the mixture solution of tetrapropyl orthosilicate and n-propanol was added into the mixed sol; after stirring for 2.0 hours, an appropriate amount of the even mixture of the Al—Ti composite oxides (powders) with di-n-propylamine and di-n-pentylamine was added therein, and stirred until a uniform colloidal was formed; thereafter, the product was loaded into a stainless-steel autoclave lined with polytetrafluoroethylene to crystallize at 185° C. for 24 hours, then cooled, filtered and dried at 120° C. to obtain the catalyst carrier with the in-situ crystallization of the SAPO-11 zeolite on the Al—Ti composite oxides. In the catalyst carrier, the contents of SAPO-11, $Al_2O_3$ and $TiO_2$ by weight are 71.1 wt %, 24.4 wt %, and 4.5 wt %, respectively.

90.0 g of the above SAPO-11 zeolite in-situ crystallized on the Al—Ti composite oxides and 2.5 g sesbania powders were mixed evenly by grinding, and then 6.0 mL nitric acid solution with the concentration of 65% by weight were added therein; after kneading sufficiently, the resultant was shaped in an extruder, dried at 120° C., and calcined at 520° C. to obtain the shaped catalyst carrier.

60.0 mL of ammonium molybdate solution containing 5.0 g of $MoO_3$ were prepared, and 5.8 mL ammonia with the concentration of 17% by weight were added therein, stirring sufficiently until the solid was dissolved completely so as to obtain the impregnating solution; then 75 g of the above shaped catalyst carrier were impregnated in the above impregnating solution, aged at room temperature for 5 hours, dried at 120° C. for 3 hours and calcined at 500° C. for 4 hours; the calcined catalyst carrier containing molybdenum was impregnated in a 60 mL mixture solution of cobalt nitrate and nickel nitrate containing 0.83 g CoO and 2.5 g NiO, aged at room temperature for 5 hours, dried at 120° C. for 3 hours and calcined at 500° C. for 4 hours to obtain the final catalyst for supplemental desulfurization and olefin multi-branched-chain hydroisomerization in the second reactor.

The reaction conditions for the heavy fraction gasoline in the first reactor were a reaction pressure of 2.0 MPa, a liquid volume space velocity of 4 $h^{-1}$, a reaction temperature of 235° C., and a hydrogen/oil volume ratio of 300; and the reaction conditions for the reaction effluent from the first reactor in the second reactor were a reaction pressure of 2.0 MPa, a liquid volume space velocity of 2.0 $h^{-1}$, a reaction temperature of 340° C., and a hydrogen/oil volume ratio of 300. The hydro-upgrading effects of the heavy fraction gasoline were shown in Table 3.

TABLE 3

Hydro-upgrading Effects of the Heavy Fraction Gasoline

| Item | Heavy fraction gasoline 1 >85° C. (feedstock) | Upgraded product of heavy fraction gasoline 1 |
|---|---|---|
| Yield (wt %) | — | 99.8 |
| Density (g/mL) | 0.780 | 0.785 |
| Distillation range (° C.) | 82-206 | 83-207 |
| Content of typical hydrocarbons (v %) | | |
| Multi-branched-chain isoalkane | 2.9 | 14.9 |
| Olefin | 39.8 | 12.3 |
| Aromatics | 26.9 | 28.5 |
| Sulfur ($\mu g \cdot g^{-1}$) | 2825 | 27 |
| RON | 89.5 | 88.1 |

(4) Blended Product of the Upgraded Light and Heavy Fraction Gasolines

Based on the cutting ratio, the light and heavy fractions of gasoline upgraded through steps (2) and (3) were blended to obtain the ultra-clean gasoline product with the ultra-low sulfur content, the ultra-low olefin content and the high octane number. Table 4 showed the properties of the full-range gasoline feedstock and the blended product of the upgraded light and heavy fraction gasolines.

TABLE 4

Properties of the Full-range Gasoline Feedstock and the Blended Product of the Upgraded Light and Heavy Fraction Gasolines

| Item | Full-range FCC gasoline feedstock 1 | Blended product of the upgraded light and heavy fraction gasolines |
|---|---|---|
| Yield (wt %) | — | 98.3 |
| Density (g/mL) | 0.735 | 0.738 |
| Distillation range (° C.) | 33-204 | 31-202 |
| Content of typical hydrocarbons (v %) | | |
| Multi-branched-chain isoalkane | 2.2 | 11.6 |
| Olefin | 48.4 | 13.7 |
| Aromatics | 16.3 | 25.9 |
| Sulfur ($\mu g \cdot g^{-1}$) | 1750 | 23 |
| Diene (gI/100 g) | 2.4 | 0.0 |
| RON | 91.3 | 90.6 |

It can be seen from Table 4 that, with the hydro-upgrading method of the invention, the sulfur content in inferior FCC gasoline may be reduced from 1750 $\mu g \cdot g^{-1}$ to <30 $\mu g \cdot g^{-1}$ with the olefin content from 48.4 v % to <15 v %, and the content of multi-branched-chain isoalkane in the product increases significantly together with the considerable increase in the content of aromatics, decreasing the RON loss to decrease to 0.7 unit while achieving ultra-deep desulfurization and great olefin reduction. Moreover, the yield of the blended product is as high as 98.3 wt %, and the product quality is far more superior than that regulated by the European IV standard for clean gasoline.

Example 2

In this example, the hydro-upgrading effects of inferior FCC gasoline with the ultra-high sulfur content and the high olefin content (feedstock 2), containing 2210 $\mu g \cdot g^{-1}$ of sulfur compounds and 51.3 v % of olefins by volume, are illustrated.

(1) Cutting the Full-Range Gasoline Feedstock

The above inferior full-range FCC gasoline was cut into the light and heavy fraction gasolines at 95° C., and the properties of the full-range gasoline feedstock and the cut light and heavy fractions were shown in Table 5.

TABLE 5

Properties of Feedstock 2

| Item | Full-range gasoline | Light fraction <95° C. | Heavy fraction >95° C. |
|---|---|---|---|
| Yield (wt %) | 100 | 45.6 | 54.4 |
| Density (g/mL) | 0.746 | 0.676 | 0.789 |
| Distillation range (° C.) | 35-206 | 34-98 | 93-209 |
| Content of typical hydrocarbons (v %) | | | |
| Multi-branched-chain isoalkane | 3.4 | 2.5 | 4.2 |
| Olefin | 51.3 | 64.7 | 37.1 |
| Aromatics | 18.1 | 3.5 | 31.4 |
| Sulfur ($\mu g \cdot g^{-1}$) | 2210 | 360 | 3761 |
| Diene (gI/100 g) | 3.5 | — | — |
| RON | 92.4 | 94.3 | 91.2 |

(2) Upgrading the Light Fraction Gasoline Through Selective Diene Removal and Desulfurization and Hydrocarbon Aromatization/Single-Branched-Chain Hydroisomerization In a 200 mL hydrogenation reactor, the catalyst for selective diene removal was loaded on the upper layer, and the catalyst for desulfurization and hydrocarbon aromatization/single-branched-chain hydroisomerization was loaded on the lower layer. After the reactor airtightness was confirmed, these catalysts were pre-sulfurized by the conventional sulfurization process and the product was collected for analysis after reaction for 500 hours.

For the above catalyst for selective diene removal, based on the stoichiometric ratio, the appropriate amounts of $K_2O$, $MoO_3$ along with NiO and $La_2O_3$ were loaded on the shaped alumina carrier successively by the conventional isovolumetric impregnation method, and the steps of aging, drying and calcining etc. were needed after each loading of active metal components; the composition by weight of this catalyst was 2 wt % NiO-6 wt % $MoO_3$-5 wt % $K_2O$-1 wt % $La_2O_3$/86 wt % $Al_2O_3$.

The composition by weight of the above catalyst for desulfurization and hydrocarbon aromatization/single-branched-chain hydroisomerization was 3 wt % NiO-8 wt % $MoO_3$-2 wt % CoO-2 wt % $B_2O_3$/62 wt % HZSM-5-20 wt % $Al_2O_3$-3 wt % $TiO_2$, in which the HZSM-5 was the alkali treated-ammonium exchanged-hydrothermal treated HZSM-5 zeolite prepared in a similar way as shown in Example 1.

The reaction conditions for the light fraction gasoline were a reaction pressure of 2.7 MPa, a reaction temperature of 390° C., a hydrogen/oil volume ratio of 600, a liquid volume space velocity of 16 $h^{-1}$ for the catalyst with the function of selective diene removal, and a liquid volume space velocity of 2.5 $h^{-1}$ for the catalyst with the functions of desulfurization and hydrocarbon aromatization/single-branched-chain hydroisomerization. The hydro-upgrading effects of the light fraction gasoline were shown in Table 6.

TABLE 6

Hydro-upgrading Effects of the Light Fraction Gasoline

| Item | Light fraction gasoline 2 <95° C. (feedstock) | Upgraded product of light fraction gasoline 2 |
|---|---|---|
| Yield (wt %) | — | 96.0 |
| Density (g/mL) | 0.676 | 0.707 |
| Distillation range (° C.) | 34-98 | 36-113 |
| Content of typical hydrocarbons (v %) | | |
| Multi-branched-chain isoalkane | 2.5 | 3.6 |
| Olefin | 64.7 | 16.8 |
| Aromatics | 3.5 | 17.5 |
| Sulfur ($\mu g \cdot g^{-1}$) | 360 | 14 |
| RON | 94.3 | 93.7 |

(3) Upgrading the Heavy Fraction Gasoline Through Selective Hydrodesulfurization and Supplemental Desulfurization and Hydrocarbon Multi-Branched-Chain Hydroisomerization In two 200 mL hydrogenation reactors in series, the catalyst for selective hydrodesulfurization was loaded in the first reactor, and the catalyst for supplemental desulfurization and hydrocarbon multi-branched-chain hydroisomerization was loaded in the second reactor. After the reactor airtightness was confirmed, these catalysts were pre-sulfurized by the conventional sulfurization process and the product was collected for analysis after reaction for 500 hours.

The composition by weight of the catalyst for selective hydrodesulfurization loaded in the first reactor was 2.5 wt % CoO-10 wt % $MoO_3$-2 wt % $K_2O$-3 wt % $P_2O_5$/60 wt % $Al_2O_3$-15.5 wt % $TiO_2$-7 wt % MgO, and this catalyst was prepared in a similar way as shown in Example 1.

The composition by weight of the in-situ crystallized SAPO-11-Al—Ti catalyst for supplemental desulfurization and hydrocarbon multi-branched-chain hydroisomerization in the second reactor was 2.0 wt % CoO-8 wt % $MoO_3$-4 wt % NiO/60 wt % SAPO-11-20 wt % $Al_2O_3$-6 wt % $TiO_2$, and this catalyst was prepared in a similar way as shown in Example 1.

The reaction conditions for the heavy fraction gasoline in the first reactor were a reaction pressure of 2.3 MPa, a liquid volume space velocity of 3.0 $h^{-1}$, a reaction temperature of 230° C., and a hydrogen/oil volume ratio of 500; and the reaction conditions in the second reactor were a reaction pressure of 2.3 MPa, a liquid volume space velocity of 1.5 $h^{-1}$, a reaction temperature of 350° C., and a hydrogen/oil volume ratio of 500. The hydro-upgrading effects of the heavy fraction gasoline were shown in Table 7.

TABLE 7

Hydro-upgrading Effects of the Heavy Fraction Gasoline

| Item | Heavy fraction gasoline 2 >95° C. (feedstock) | Upgraded product of heavy fraction gasoline 2 |
|---|---|---|
| Yield (wt %) | — | 99.3 |
| Density (g/mL) | 0.789 | 0.793 |
| Distillation range (° C.) | 93-209 | 92-208 |
| Content of typical hydrocarbons (v %) | | |
| Multi-branched-chain isoalkane | 4.2 | 17.5 |
| Olefin | 37.1 | 7.2 |

TABLE 7-continued

Hydro-upgrading Effects of the Heavy Fraction Gasoline

| Item | Heavy fraction gasoline 2 >95° C. (feedstock) | Upgraded product of heavy fraction gasoline 2 |
|---|---|---|
| Aromatics | 31.4 | 32.9 |
| Sulfur ($\mu g \cdot g^{-1}$) | 3761 | 22 |
| RON | 91.2 | 89.5 |

(4) Blended Product of the Upgraded Light and Heavy Fraction Gasolines

Based on the cutting ratio, the light and heavy fractions of gasoline upgraded through steps (2) and (3) were blended to obtain the ultra-clean gasoline product with the ultra-low sulfur content, the ultra-low olefin content and the high octane number. Table 8 showed the properties of the full-range gasoline feedstock and the blended product of the upgraded light and heavy fraction gasolines.

TABLE 8

Properties of the Full-range Gasoline Feedstock and the Blended Product of the Upgraded Light and Heavy Fraction Gasolines

| Item | Full-range gasoline 2 (Feedstock 2) | Blended product of the upgraded light and heavy fraction gasolines |
|---|---|---|
| Yield (wt %) | — | 98.2 |
| Density (g/mL) | 0.746 | 0.751 |
| Distillation range (° C.) | 35-206 | 33-208 |
| Content of typical hydrocarbons (v %) | | |
| Multi-branched-chain isoalkane | 3.4 | 13.7 |
| Olefin | 51.3 | 12.8 |
| Aromatics | 18.1 | 27.9 |
| Sulfur ($\mu g \cdot g^{-1}$) | 2210 | 20 |
| Diene (gI/100 g) | 3.5 | 0.0 |
| RON | 92.4 | 91.5 |

It can be seen from Table 8 that, with the hydro-upgrading method of the invention, the sulfur content in inferior FCC gasoline can be reduced from 2210 $\mu g \cdot g^{-1}$ to <30 $\mu g \cdot g^{-1}$ with the olefin content reduced from 51.3 v % to <15 v %, and the content of multi-branched-chain isoalkane in the product increases significantly together with the considerable increase in the content of aromatics, decreasing the RON loss to 0.9 unit while achieving ultra-deep desulfurization and great olefin reduction. Moreover, the yield of the blended product is as high as 98.2 wt %, and the product quality is far more superior than that regulated by the European IV standard for clean gasoline.

The results of the above two examples above show that, with the method of the invention, inferior FCC gasoline with the ultra-high sulfur content of 1400-2500 $\mu g \cdot g^{-1}$ and the high olefin content of 40-55 v % can be upgraded into an much cleaner gasoline product than European IV clean gasoline, thus establishing an excellent technical basis for producing the sulfur-free gasoline in the future.

The invention claimed is:

1. A method of hydro-upgrading inferior gasoline through deep desulfurization and octane number recovery, comprising:

cutting inferior full-range gasoline into a light fraction gasoline and a heavy fraction gasoline at 80 to 110° C.;

contacting the light fraction gasoline with a catalyst for selective diene removal and a catalyst for desulfurization and hydrocarbon aromatization/single-branched-chain hydroisomerization;

contacting the heavy fraction gasoline with a catalyst for selective hydrodesulfurization in a first reactor, and contacting a resulting reaction effluent from the first reactor with a catalyst for supplemental desulfurization and hydrocarbon multi-branched-chain hydroisomerization in a second reactor; and blending the treated light and heavy fraction gasolines to obtain an ultra-clean gasoline product.

2. The hydro-upgrading method according to claim 1, wherein the light fraction gasoline contacts the catalyst for selective diene removal and the catalyst for desulfurization and hydrocarbon aromatization/single-branched-chain hydroisomerization successively in the same reactor.

3. The hydro-upgrading method according to claim 1, wherein, the catalyst for selective diene removal comprises 4-7 wt % $MoO_3$, 1-3 wt % NiO, 3-5 wt % $K_2O$, and 1-4 wt % $La_2O_3$, with the balance of the catalyst comprising $Al_2O_3$, based on the total weight of said catalyst.

4. The hydro-upgrading method according to claim 1, wherein the catalyst for desulfurization and hydrocarbon aromatization/single-branched-chain hydroisomerization comprises 2-6 wt % NiO, 4-10 wt % $MoO_3$, 1-5 wt % CoO, 2-5 wt % $B_2O_3$, and 50-70 wt % of alkali treated-ammonium exchanged-hydrothermally treated HZSM-5 zeolite, with the balance of the catalyst comprising Al—Ti composite oxides, based on the total weight of said catalyst.

5. The hydro-upgrading method according to claim 1, wherein the catalyst for selective hydrodesulfurization comprises 10-18 wt % $MoO_3$, 2-6 wt % CoO, 1-7 wt % $K_2O$ and 2-6 wt % $P_2O_5$, with the balance of the catalyst comprising Al—Ti—Mg composite oxides, based on the total weight of said catalyst.

6. The hydro-upgrading method according to claim 5, wherein the composition by weight of the Al—Ti—Mg composite oxides in the catalyst for selective hydrodesulfurization is: 60-75 wt % $Al_2O_3$, 5-15 wt % $TiO_2$ and 3-10 wt % MgO, and wherein the Al—Ti—Mg composite oxides are prepared by the fractional precipitation of aluminum, titanium and magnesium salts.

7. The hydro-upgrading method according to claim 1, wherein the catalyst for supplemental desulfurization and hydrocarbon multi-branched-chain hydroisomerization comprises 3-8 wt % $MoO_3$, 1-3 wt % CoO, 2-5 wt % NiO, and 50-70 wt % SAPO-11 zeolites, with the balance of the catalyst comprising Al—Ti composite oxides, based on the total weight of said catalyst.

8. The hydro-upgrading method according to claim 4, wherein the composition by weight of the Al—Ti composite oxides in the catalyst for desulfurization and hydrocarbon aromatization/single-branched-chain hydroisomerization is 15-40 wt % $Al_2O_3$ and 2-15 wt % $TiO_2$, and the Al—Ti composite oxides are prepared by the fractional precipitation of aluminum and titanium salts.

9. The hydro-upgrading method according to claim 7, wherein the composition by weight of the Al—Ti composite oxides in the catalyst is 15-40 wt % $Al_2O_3$ and 2-15 wt % $TiO_2$, and the Al—Ti composite oxides are prepared by the fractional precipitation of aluminum and titanium salts.

10. The hydro-upgrading method according to claim 7, wherein the SAPO-11 zeolites are synthesized by using $C_2$-$C_8$ alkyl silicon esters as organic silicon sources and simultaneously adding the same organic alcohol as the alcohol from the hydrolysis of the organic silicon sources, wherein the template used in the synthesis of the SAPO-11 zeolites is a mixture of di-n-propylamine and long-chain organic amine with a molar ratio of 3-10:1, and wherein the long-chain organic amine is an alkyl diamine having a carbon chain length of $C_4$-$C_8$.

11. The hydro-upgrading method according to claim 7, wherein the SAPO-11 zeolites have a molar ratio of $SiO_2/Al_2O_3$ of 0.1-2.0, and a molar ratio of $P_2O_5/Al_2O_3$ of 0.5-2.5, and wherein the zeolites are combined with the Al—Ti composite oxides by means of in-situ crystallization of the SAPO-11 zeolites on the Al—Ti composite oxides.

12. The hydro-upgrading method according to claim 1, wherein:

the reaction conditions for the light fraction gasoline comprise a reaction pressure of 1-3 MPa, a reaction temperature of 370-430° C., a hydrogen/oil volume ratio of 200-600, a liquid volume space velocity of 12-16 $h^{-1}$ for the catalyst with the function of selective diene removal and a liquid volume space velocity of 1-4 $h^{-1}$ for the catalyst with the functions of desulfurization and hydrocarbon aromatization/single-branched-chain hydroisomerization;

the reaction conditions for the heavy fraction gasoline in the first reactor comprise a reaction pressure of 1-3 MPa, a liquid volume space velocity of 3-6 $h^{-1}$, a reaction temperature of 230-290° C., and a hydrogen/oil volume ratio of 200-600; and the reaction conditions for the reaction effluent from the first reactor in the second reactor comprise a reaction pressure of 1-3 MPa, a liquid volume space velocity of 1-4 $h^{-1}$, a reaction temperature of 300-360° C., and a hydrogen/oil volume ratio of 200-600.

13. A method of hydro-upgrading inferior gasoline through deep desulfurization and octane number recovery, comprising:

cutting inferior full-range gasoline into a light fraction gasoline and a heavy fraction gasoline at 80 to 110° C.;

contacting the light fraction gasoline with a catalyst for selective diene removal and a catalyst for desulfurization and hydrocarbon aromatization/single-branched-chain hydroisomerization, wherein the catalyst for selective diene removal comprises 4-7 wt % $MoO_3$, 1-3 wt % NiO, 3-5 wt % $K_2O$, and 1-4 wt % $La_2O_3$, with the balance of the catalyst comprising $Al_2O_3$ based on the total weight of said catalyst, and wherein the catalyst for desulfurization and hydrocarbon aromatization/single-branched-chain hydroisomerization is 2-6 wt % NiO, 4-10 wt % $MoO_3$, 1-5 wt % CoO, 2-5 wt % $B_2O_3$, and 50-70 wt % of alkali treated-ammonium exchanged-hydrothermally treated HZSM-5 zeolite, with the balance of the catalyst comprising Al—Ti composite oxides, based on the total weight of said catalyst;

contacting the heavy fraction gasoline with a catalyst for selective hydrodesulfurization in a first reactor, wherein the catalyst for selective hydrodesulfurization comprises 10-18 wt % $MoO_3$, 2-6 wt % CoO, 1-7 wt % $K_2O$ and 2-6 wt % $P_2O_5$, with the balance of the catalyst comprising Al—Ti—Mg composite oxides, based on the total weight of said catalyst;

contacting a resulting reaction effluent from the first reactor with a catalyst for supplemental desulfurization and hydrocarbon multi-branched-chain hydroisomerization in a second reactor, wherein the catalyst for supplemental desulfurization and hydrocarbon multi-branched-chain hydroisomerization is 3-8 wt % $MoO_3$, 1-3 wt % CoO, 2-5 wt % NiO, and 50-70 wt % SAPO-11 zeolites, with the balance of the catalyst comprising Al—Ti composite oxides, based on the total weight of said catalyst; and blending the treated light and heavy fraction gasolines to obtain the ultra-clean gasoline product.

14. The method of claim 1, wherein the inferior full-range gasoline is FCC gasoline having a sulfur content of 1400-2500 μg.g-1 and an olefin content of 40-55% by volume.

* * * * *